US006085784A

United States Patent [19]

Bloom et al.

[11] Patent Number: 6,085,784

[45] Date of Patent: Jul. 11, 2000

[54] QUICK CONNECT HOSE ASSEMBLY

[75] Inventors: Mark S. Bloom, Ventura; Donald J. Segien, Jr., Chatsworth, both of Calif.; Neil G. Bullock, West Jordan, Utah

[73] Assignee: Emhart Inc., Newark, Del.

[21] Appl. No.: 09/133,461

[22] Filed: Aug. 13, 1998

[51] Int. Cl.[7] ..... E03B 3/00

[52] U.S. Cl. ..... 137/606; 137/801; 4/676

[58] Field of Search ..... 137/606, 801; 4/676, 675, 677, 678

[56] References Cited

U.S. PATENT DOCUMENTS

| | | | |
|---|---|---|---|
| Re. 30,559 | 3/1981 | Schmitt . | |
| 1,146,662 | 7/1915 | Staab | 137/606 X |
| 2,348,238 | 5/1944 | Beeke et al. | 137/606 X |
| 3,387,309 | 11/1965 | Johnson . | |
| 3,534,988 | 10/1970 | Lindsey . | |
| 4,005,883 | 2/1977 | Guest . | |
| 4,026,328 | 5/1977 | Nelson | 137/801 |
| 4,290,445 | 9/1981 | Turner . | |
| 4,564,040 | 1/1986 | Rudelick . | |
| 5,584,513 | 12/1996 | Sweeny et al. . | |
| 5,630,628 | 5/1997 | Mönch . | |
| 5,669,417 | 9/1997 | Lian-Jie . | |
| 5,685,341 | 11/1997 | Chrysler et al. . | |
| B1 5,465,749 | 5/1997 | Sauter et al. . | |

FOREIGN PATENT DOCUMENTS

| | | |
|---|---|---|
| 2525296 | 10/1983 | France . |
| 627627 | 3/1936 | Germany . |
| 849078 | 9/1952 | Germany . |
| 2231702 | 1/1973 | Germany . |
| 1326352 | 8/1973 | United Kingdom . |
| 8800263 | 1/1988 | WIPO . |

*Primary Examiner*—David J. Walczak
*Attorney, Agent, or Firm*—Harold Weinstein

[57] ABSTRACT

A quick connect hose assembly is provided for a widespread faucet including a spout and a pair of end bodies mounted to a deck at spaced locations from the spout. The quick connect hose assembly includes a T-connector slidably mounted on an end of a waterway tube connected to the spout. The T-connector includes a pair of serrated hose connecting portions. A pair of connector members are provided including a hollow body portion which slidably receives a bottom portion of the end bodies and an outwardly extending serrated hose connecting portion extending from the hollow body portion. A first hose is connected between the T-connector and one of the connector members and a second hose is connected between the T-connector and the other connector member.

17 Claims, 11 Drawing Sheets

QUICK CONNECT HOSE ASSEMBLY

BACKGROUND OF THE INVENTION

Field of the Invention

The present invention relates generally to a faucet assembly, and more particularly, to a quick connect hose assembly for a widespread faucet.

BACKGROUND AND SUMMARY OF THE INVENTION

In conventional faucet assemblies, the hose assembly for a widespread faucet includes two hoses with threaded fittings on each end. The fittings are threaded into place under the sink after the end bodies have been mounted on the sink deck. The threaded fittings require a wrench to tighten. The assembly which is typically required to be performed from the underside of the deck is often awkward and uncomfortable for the installer.

It is an object of the present invention to provide a quick connect hose assembly that reduces the time and effort to make the hose connection, and that is simple in construction, economical to produce, and highly reliable in operation. It is another object of the present invention to provide a quick connect hose assembly that is easy to assemble or disassemble, as desired. It is still another object of the present invention to provide a quick connect hose assembly which can be installed in a quick and easy manner with a minimum of tools or operations.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

With reference to the accompanying drawings, the quick install faucet assembly and quick connect hose assembly according to the principles of the present invention will be described The quick install faucet assembly described herein includes a spout 10 and a pair of separately mounted end body valve assemblies 12, 14. However, it should be understood that the principles of the present invention may also be applied to a faucet assembly having the spout 10 and valve assemblies 12, 14 as a single unit.

Figure 10:
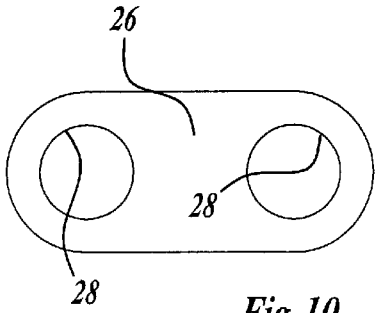
FIG. 10 is a plan view of a mounting bracket for use according to the principles of the present invention.
Figure 7:
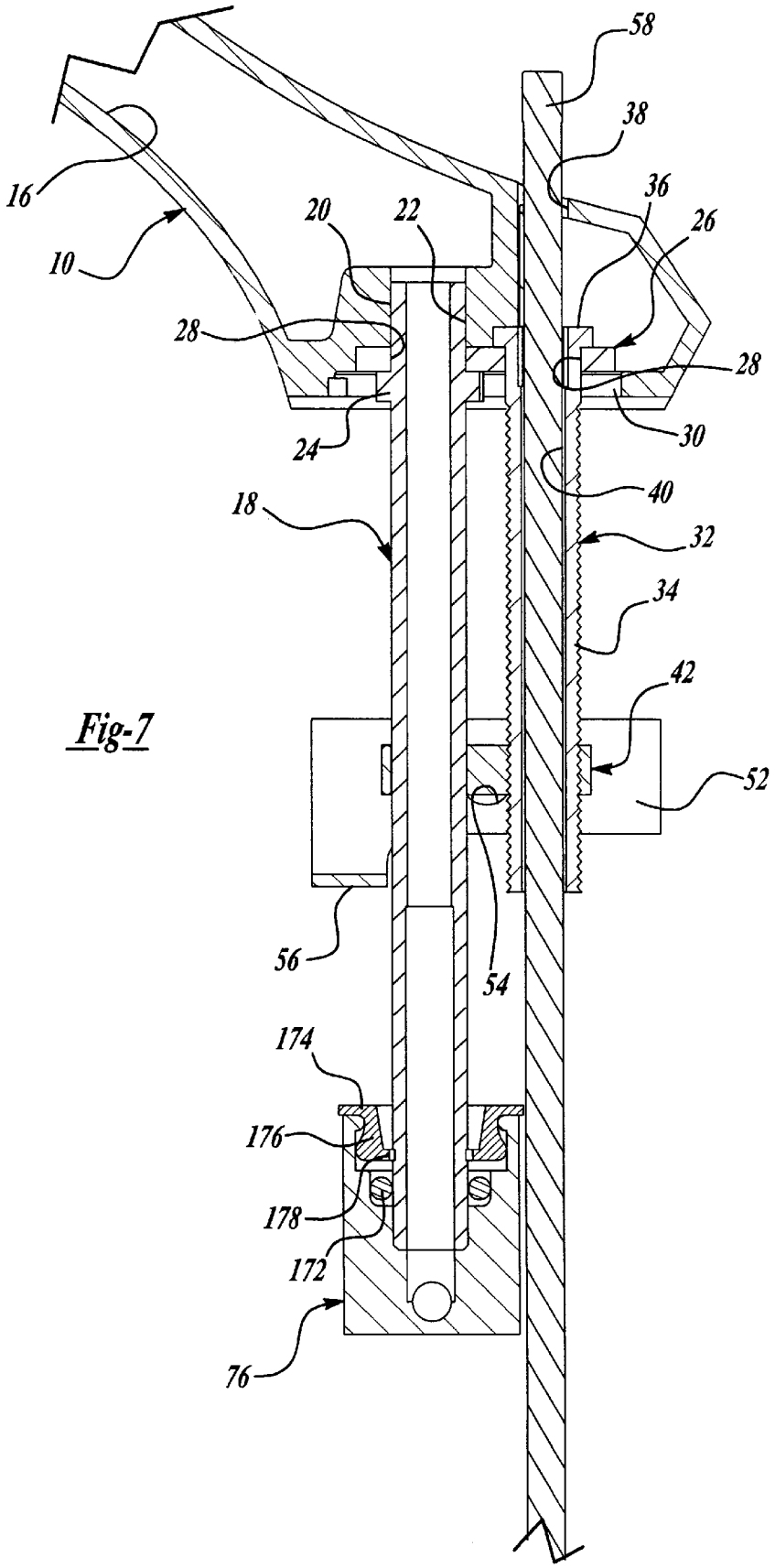
FIG. 7 is a cross-sectional view of the quick install spout assembly according to the principles of the present invention.

As shown in FIG. 7, the spout 10 includes a water passage 16 which communicates with a waterway tube 18. The waterway tube 18 has a threaded end portion 20 which engages an internally threaded portion 22 of the spout 10. The waterway tube 18 includes a radially extending hexagonal flange portion 24. A guide bracket 26 is provided with a pair of openings 28, as shown in FIG. 10, and receives the threaded portion 20 of the waterway tube 18 through one of the openings 28. The radially extending flange portion 24 supports the guide bracket 26 within a lower cavity 30 defined within the spout 10. The threaded portion 20 of waterway tube 18 is engaged with the internally threaded portion 22 of spout 10. As is known in the art, a Teflon® tape, or other seal means, can be provided on the threaded portion 20 of the waterway tube 18 in order to provide a water sealed fit.

A threaded rod 32 is provided with a hollow cylindrical body 34 which is externally threaded and is provided with an upper radially extending flange 36. The threaded rod 32 extends through the second opening 28 in guide bracket 26 while flange 36 rests against the guide bracket 26. The threaded rod 32 is aligned with an opening 38 in the spout 10 which allows access of an allen wrench for engaging an internal hexagonal engagement portion 40 provided in the upper portion of the threaded rod 32. In the completed faucet assembly, a pop-up rod 58 extends through the central opening of the threaded rod 32 and through the opening 38 in spout 10. As is well known in the art, the pop-up rod 58 engages a drain stopper assembly (not shown) for opening and closing the drain stopper.

Figure 8:
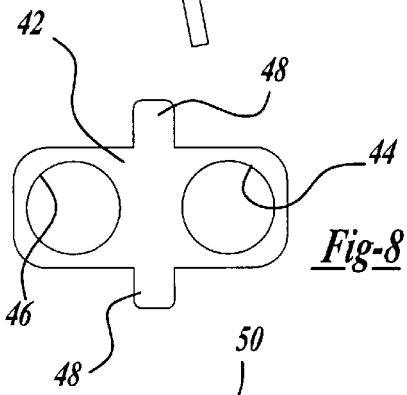
FIG. 8 is a plan view of the spout nut, according to the principles of the present invention.
Figure 9:
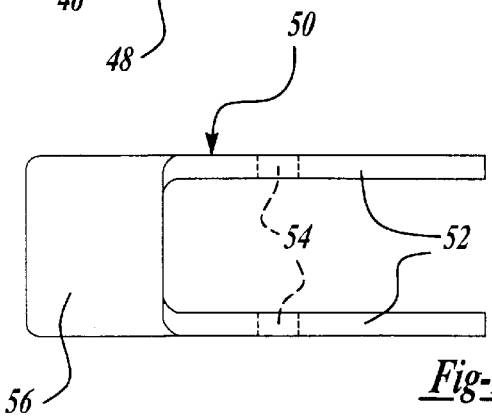
FIG. 9 is a plan view of the pivoting retainer according to the principles of the present invention.

A nut member 42 is threadedly engaged with the threaded rod 32. As best shown in FIG. 8, the nut member 42 includes a threaded opening 44 which engages the threaded rod 32 and a second opening 46 which slidably receives the waterway tube 18. The nut member 42 also includes two pivot arms 48 which extend from opposite sides of the nut member 42. A retainer member 50 is pivotally mounted to the nut member 42. The retainer member 50 includes a pair of generally parallel arms 52 having centrally located pivot openings 54. A cross bar 56 extends between the arms 52 as best shown in FIG. 9. The pivot arms 48 of nut member 42 extend through pivot openings 54 of retainer member 50 for pivotally supporting the retainer member 50 thereon. It should be noted that the nut member 42 can be modified to include a pivot pin extending therethrough for supporting the retainer member 50.

Figure 2:
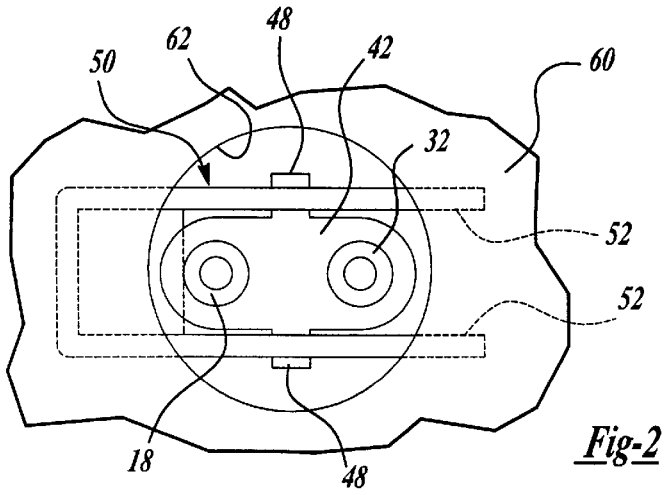
FIG. 2 is a cross-sectional view taken along line 2 of FIG. 1.
Figure 3:
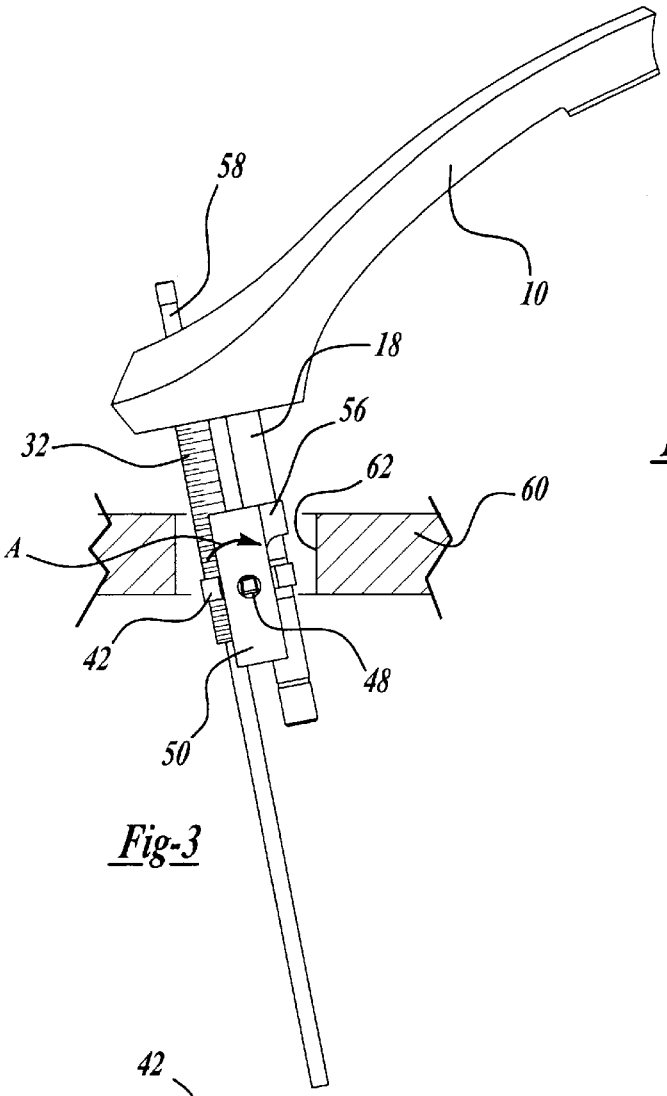
FIG. 3 is a side view illustrating the insertion of the spout through an opening in the deck according to the principles of the present invention.
Figure 4:
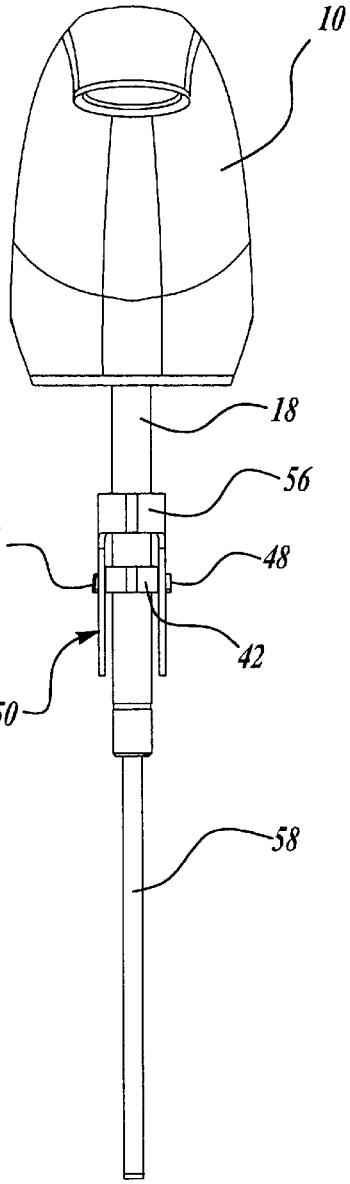
FIG. 4 is a front view of the spout assembly with the pivoting retainer in the upright position.
Figure 5:
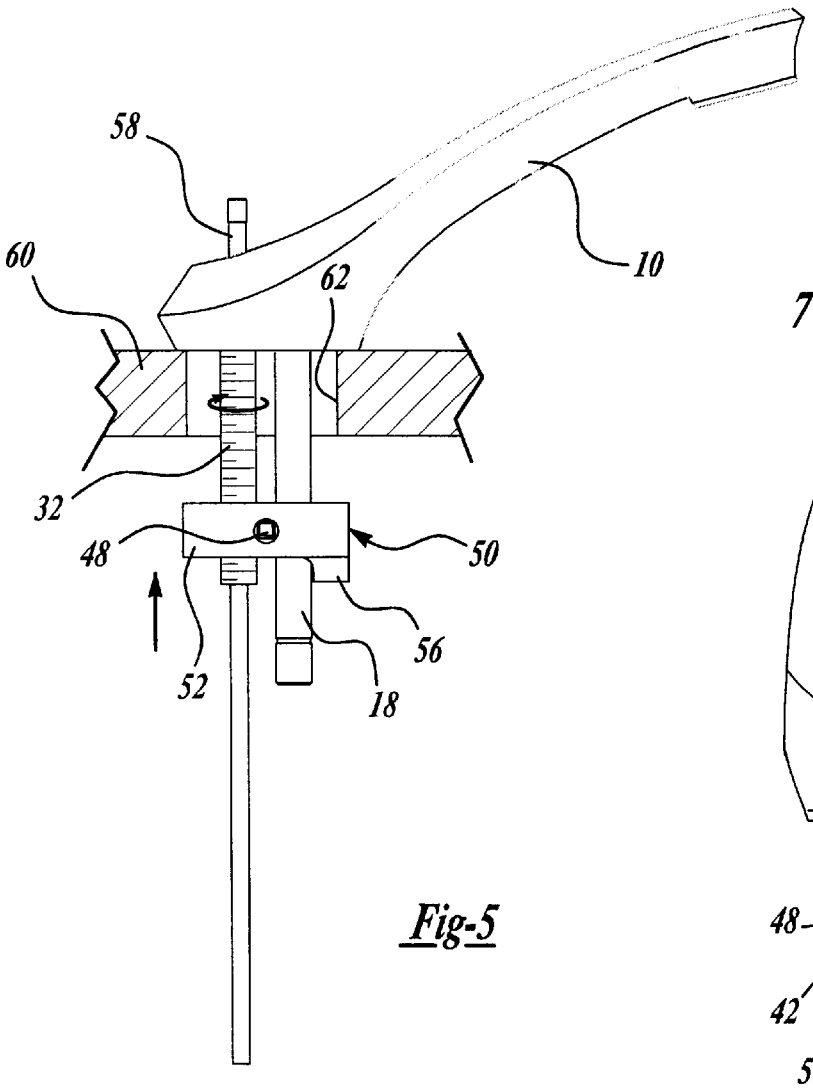
FIG. 5 is a side view of the spout assembly inserted in an opening in the deck with the pivoting retainer in the horizontal position, according to the principles of the present invention.
Figure 6:
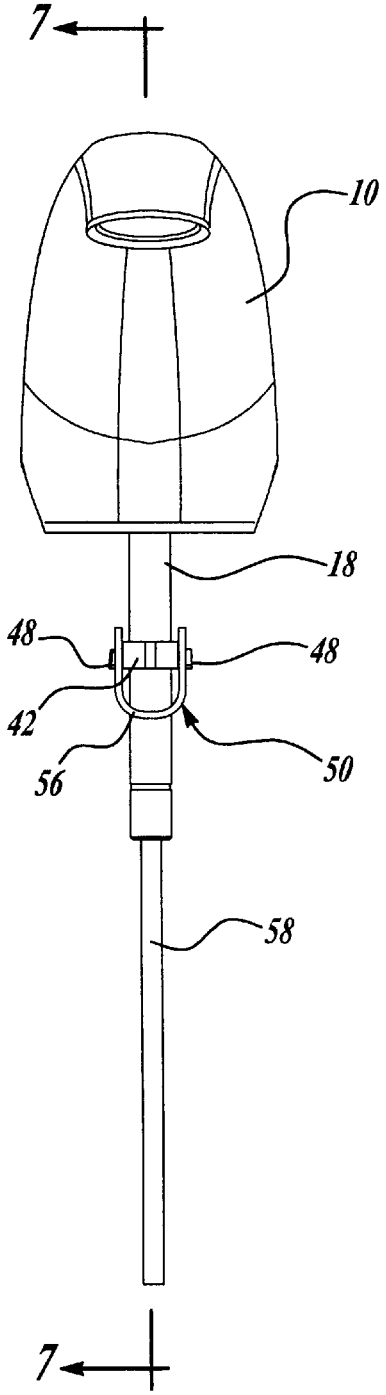
FIG. 6 is a front view of the spout assembly with the pivoting retainer in the horizontal position for engaging the deck, according to the principles of the present invention.

With reference to FIGS. 3–6, the installation of the spout according to the principles of the present invention will now be described. The spout is mounted to a deck or mounting surface 60 which is provided with an opening 62 for receiving the threaded rod 32 and waterway tube 18 of the spout assembly. As shown in FIG. 3, the retainer member 50 is pivoted to a generally vertical position extending longitudinally with the waterway tube 18 and threaded rod 32 such that the cross bar 56 rests against the waterway tube 18. The spout assembly can be optionally tilted counter clockwise, as shown in FIG. 3, so that the cross bar 56 of the retainer member 50 is stable against the waterway tube 18. Otherwise, the installer can hold the retainer member 50 in the vertical position upon insertion through the opening 62. After the retainer member 50 passes through the opening 62 in the deck 60 and the spout is rotated to the final position such that the threaded rod 32 and waterway tube 18 extend generally vertically, the weight of the cross bar portion 56 of the retainer member 50 causes the retainer member 52 to rotate in a direction of arrow A, as shown in FIG. 3, until the cross bar 56 contacts the waterway tube 18 in a generally horizontal position as shown in FIG. 5. At this point, an allen wrench can be inserted through the opening 38 in the spout 10 to engage the hexagonal portion 40 of the threaded rod 32. The threaded rod 32 can then be turned in order to draw the nut member 42 and retainer member 50 in an upward direction so that the end portions of the parallel arms 52 of the retainer member 50 engage the underside of the deck 60 at four points spaced about opening 62, as best shown in FIG. 2. The pop-rod 58 is slidably received in the opening in the threaded rod 32 and can be easily removed so that the allen wrench can be inserted through the opening 38 of spout 10 to engage the hexagonal portion 48 of the threaded rod 32.

Figure 1:
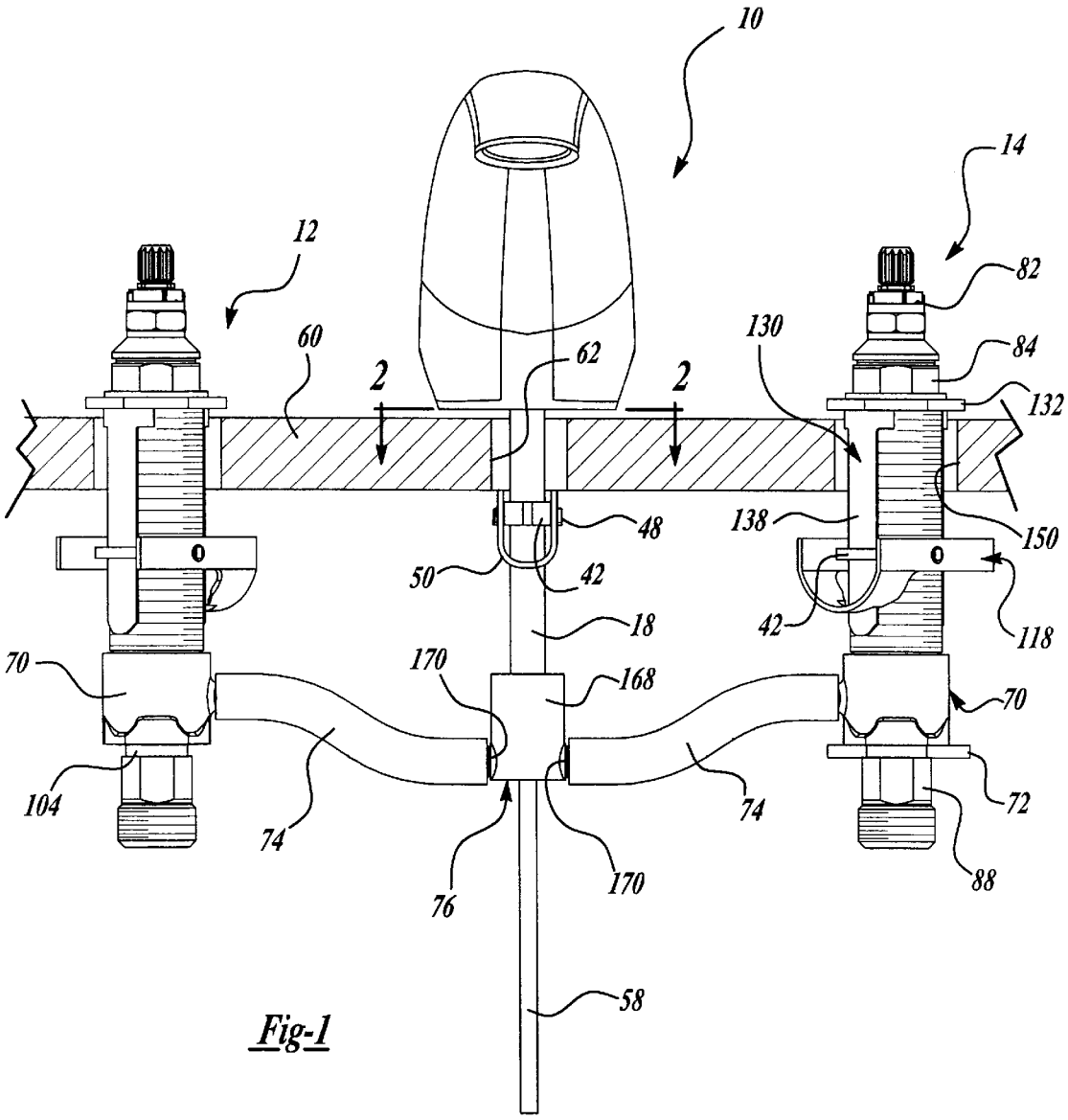
FIG. 1 is a front view of the quick connect hose assembly for a widespread faucet according to the principles of the present invention.

As shown in FIG. 1, the quick install faucet assembly of the present invention is provided with first and second end body valve assemblies 12, 14. One of the end body valve assemblies 12 is provided for the hot water line while the other of the end body valve assemblies 14 is for the cold water supply line. According to the quick connect hose assembly according to the present invention, each end body valve assembly 12, 14 is provided with an end connector 70, secured in place by a connector clip 72, for communicating water via interconnecting hoses 74 to the T-joint connector 76 mounted to the waterway tube 18 of spout assembly 10.

Figure 16:
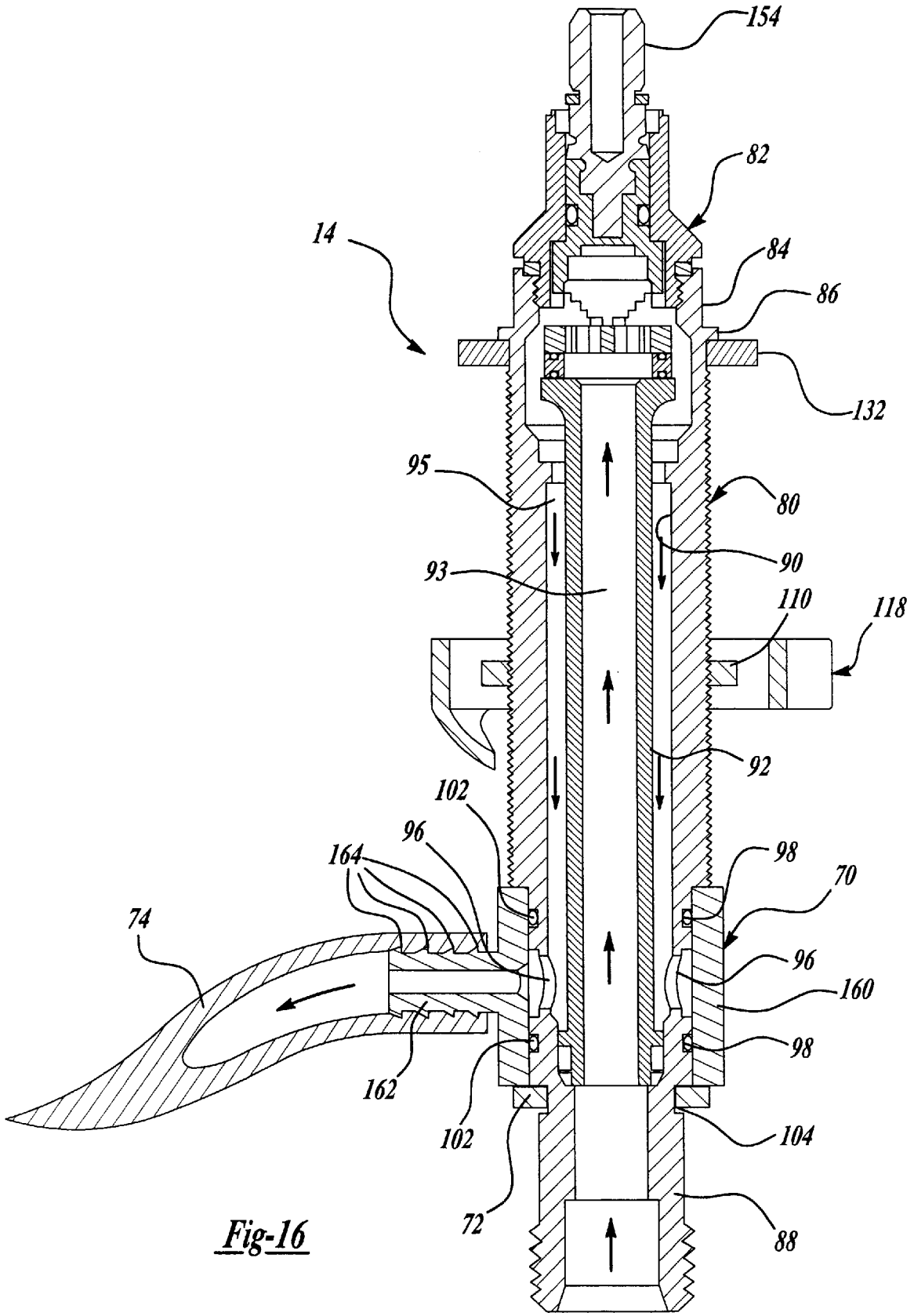
FIG. 16 is a cross-sectional view of the end body valve assembly according to the principles of the present invention.
Figure 20:
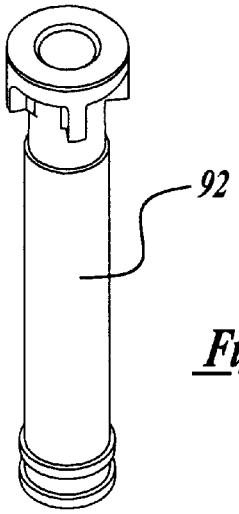
FIG. 20 is a perspective view of the spacer tube for use with the end body valve assembly according to the principles of the present invention.

With reference to FIG. 16, end body valve assembly 14 will be described. It should be understood that the end body valve assemblies 12, 14 have identical configurations and that a separate detailed description of each valve assembly is unnecessary. The end body valve assembly 14 includes a threaded body 80 mounted to a shut-off valve 82. The threaded body 80 includes an upper hexagonal head portion 84 provided with a radially extending flange 86 below the hexagonal head portion 84. The threaded body 80 also includes a hollow longitudinally extending base portion 88 which defines the waterflow path as best shown in FIG. 16. The threaded body 80 has a hollow central portion 90 which receives a spacer tube 92 (shown in FIG. 20). Spacer tube 92 has a hollow opening therethrough which defines the central flowpath 93 which communicates fluid through the shut-off-valve 82. The shut-off valve 82 communicates water from the waterflow path 93 to a concentrically formed waterflow path 95 between the threaded body 80 and spacer tube 92 to communicate water to radially extending openings 96 in the base portion 88 of the threaded body 80. The openings 96 communicate with the end connector 70 for communicating fluid through the interconnecting hose 74. The base portion 88 of threaded body 80 is provided with radial grooves 98 for supporting O-rings 102 between the base portion 88 and the end connector 70 for providing a water-tight fit between the end connector 70 and the threaded body 80. The base portion 88 of the threaded body 80 includes a recessed area between the O-rings 102 for water flow. The base portion 88 also includes a groove 104 for receiving a retaining clip 72, as shown in FIGS. 1 and 16.

Figure 17:
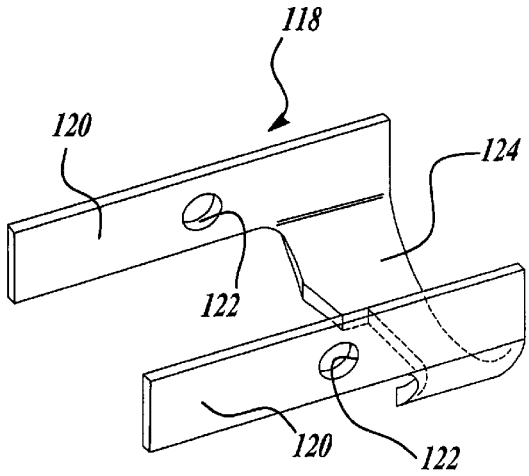
FIG. 17 is a perspective view of the pivoting retainer according to the principles of the present invention.
Figure 18:
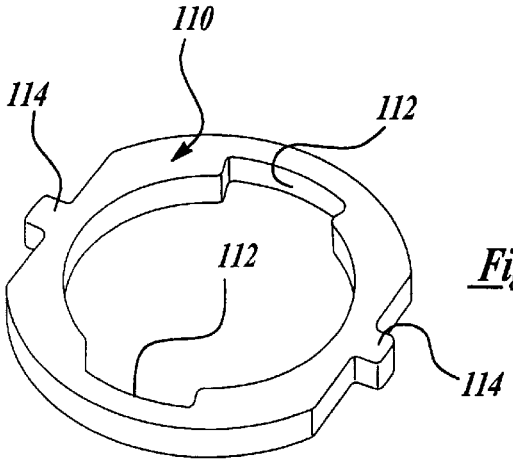
FIG. 18 is a perspective view of the threaded nut for use with the end body valve assembly according to the principles of the present invention.
Figure 19:
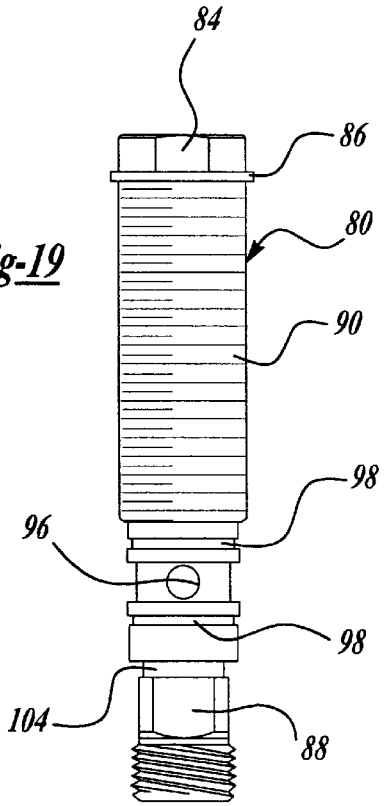
FIG. 19 is a side view of the threaded body for use with the end body valve assembly according to the principles of the present invention.

A threaded nut 110 is threadedly engaged with the threaded body 80. Threaded nut 110, as best shown in FIG. 18, is provided with a pair of oppositely disposed guide recesses 112 and a pair of oppositely disposed pivot arms 114. A pivoting retainer 118, as best shown in FIG. 17, is pivotally mounted to the threaded nut 110. The pivoting retainer 118 includes a pair of generally parallel arms 120 each provided with a pivot opening 122 for receiving the pivot arms 114 for pivotally supporting the retainer member 118 to the threaded nut 110. The retainer member 118 includes a cross bar portion 124 which extends between the arms 120.

Figure 21:
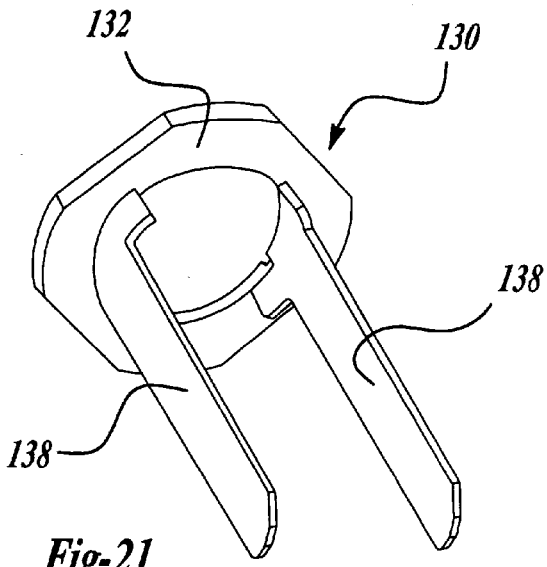
FIG. 21 is a perspective view of the nut guide assembly for use with the end body valve assembly according to the principles of the present invention.
Figure 22:
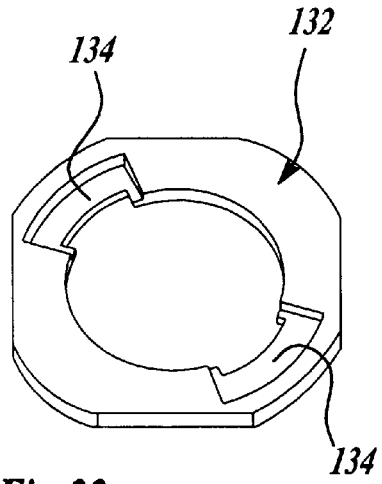
FIG. 22 is a perspective view of the guide flange of the nut guide assembly according to the principles of the present invention.
Figure 23:
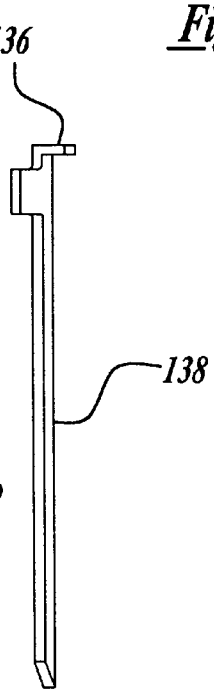
FIGS. 23 and 24 show side and front views, respectively, of the guide arm of the nut guide assembly according to the principles of the present invention.
Figure 24:
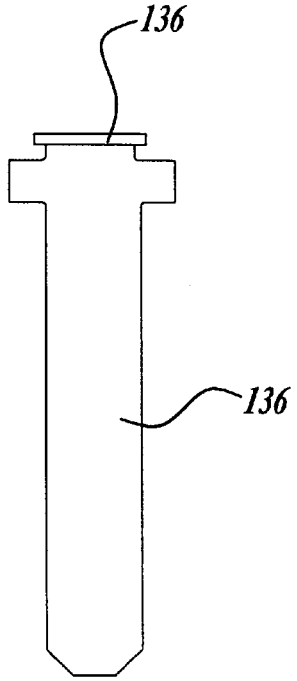
Figure 25:
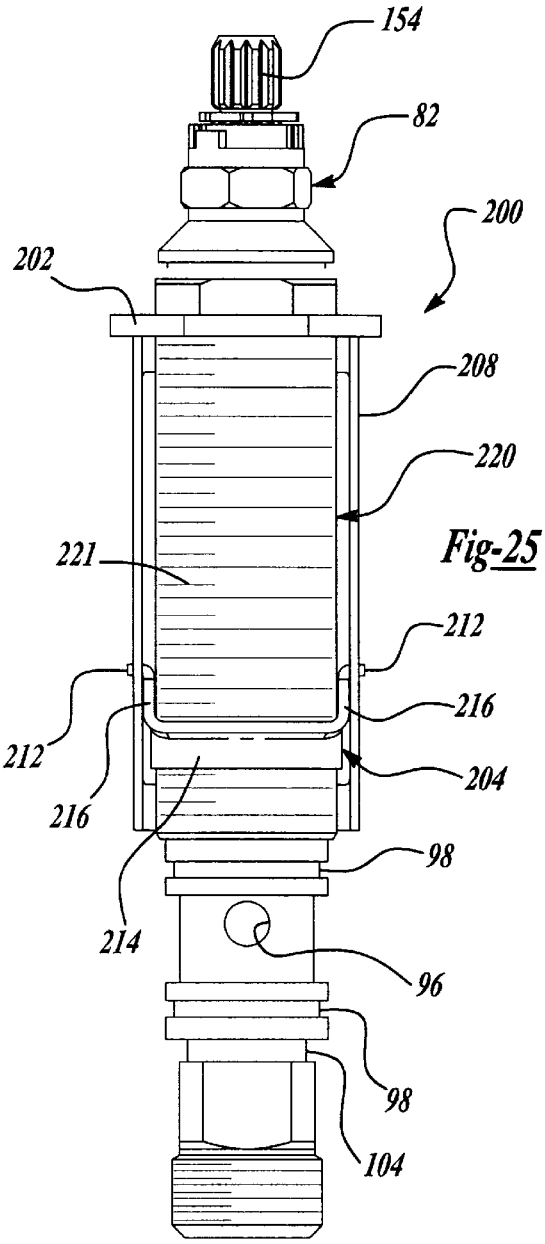
FIG. 25 is a first side view of a quick install end body valve assembly according to a second embodiment of the present invention.
Figure 26:
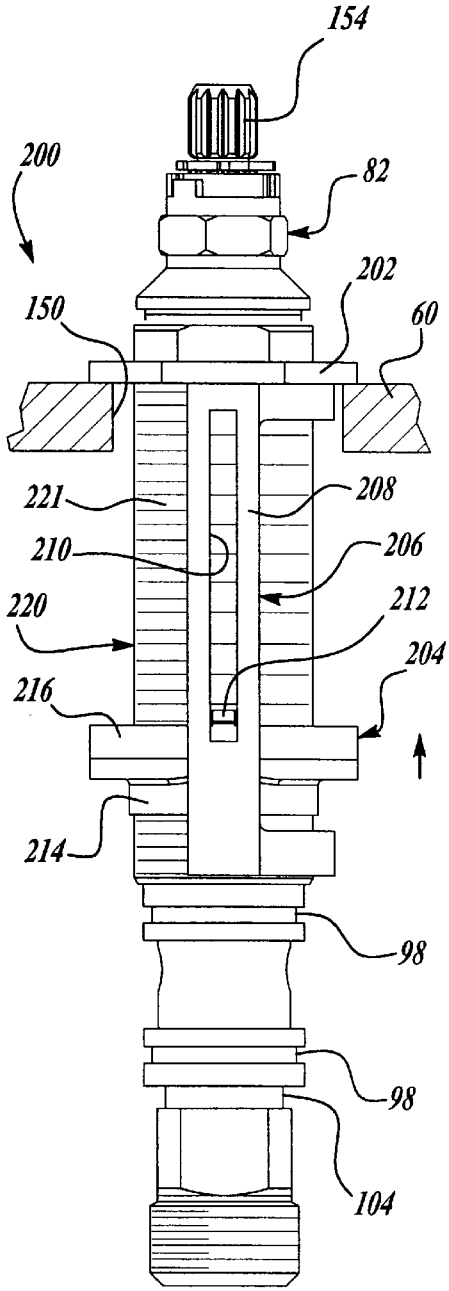
FIG. 26 is a second side view of the end body valve assembly shown in FIG. 25.

A nut guide assembly 130, as best shown in FIG. 21, is provided for guiding the threaded nut 110 and preventing rotation of the threaded nut 110. The nut guide assembly 130 includes a guide flange 132 which abuts against the radially extending flange 86 of threaded body 80. As best shown in FIG. 16, guide flange 132 includes a pair of recesses 134 which mate with an upper bend portion 136 of oppositely disposed guide arms 138, as best shown in FIGS. 23 and 24. As the guide flange 132 rests against the radially extending flange 86, the flange 86 helps to hold the upper bend portion 136 of the arms 138 in the recesses 134. The guide arms 138 extend through the guide recesses 112 in the threaded nut 110 to prevent the threaded nut 110 from rotating relative to the nut guide assembly 130. Accordingly, as the threaded body 80 is rotated, the threaded nut 110 is prevented from rotating relative to the nut guide assembly 130 therefore causing the threaded nut 110 to move upward and downward along the threaded body 80 depending upon the direction of rotation of the threaded body 80. As the threaded nut 110 moves up and down along the threaded body 80 upon rotation of the threaded body 80, the retainer member 118 moves therewith.

Figure 11:
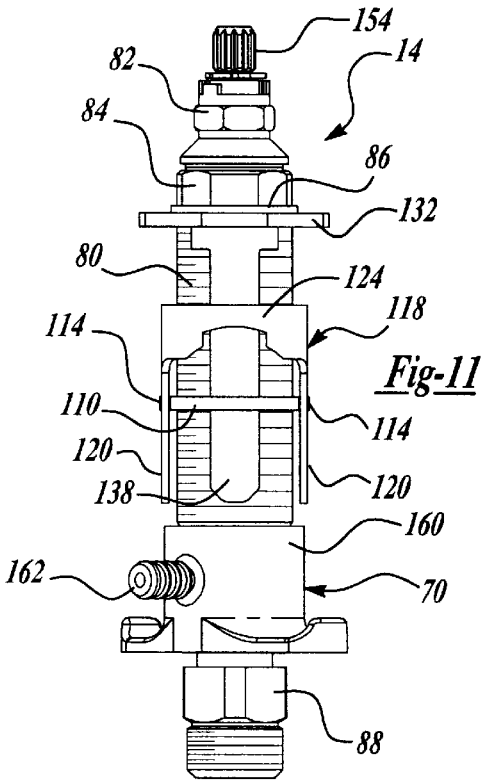
FIG. 11 is a first side view of a quick install end body valve assembly with the pivoting retainer in the upright position according to the principles of the present invention.
Figure 12:
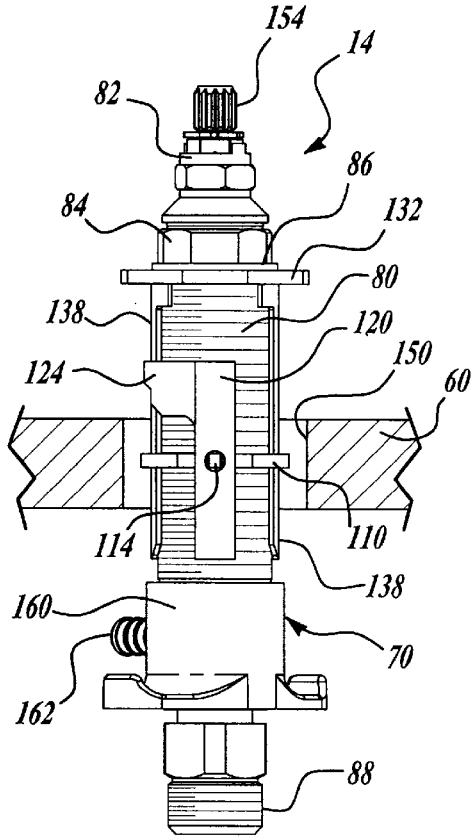
FIG. 12 is a second side view of the end body valve assembly with the pivoting retainer in the upright position according to the principles of the present invention.
Figure 13:
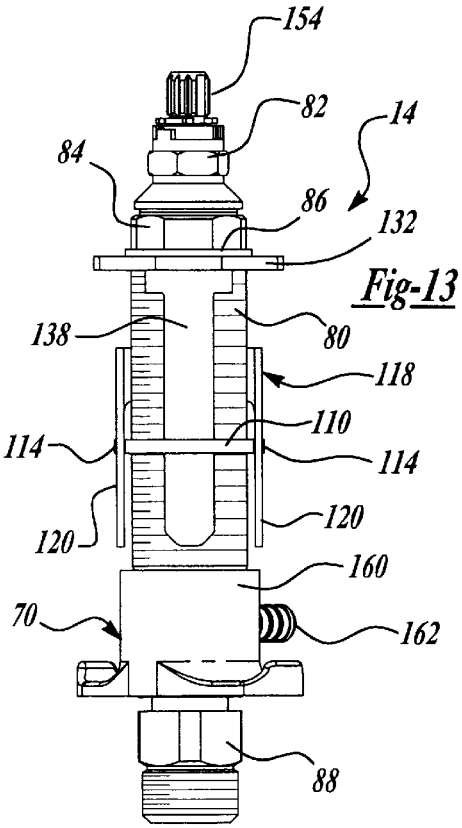
FIG. 13 is a third side view of the end body valve assembly with the pivoting retainer in the upright position according to the principles of the present invention.
Figure 14:
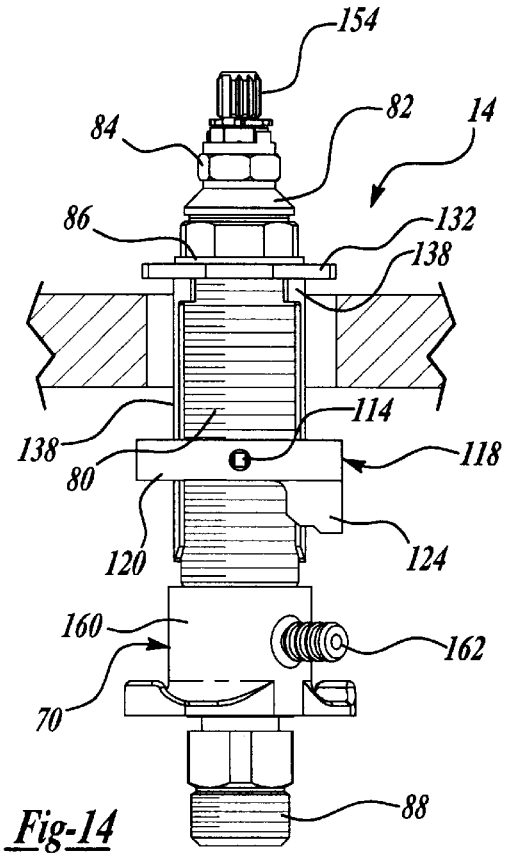
FIG. 14 is a side view of the end body valve assembly inserted in an opening in a deck and with the pivoting retainer in the horizontal position according to the principles of the present invention.
Figure 15:
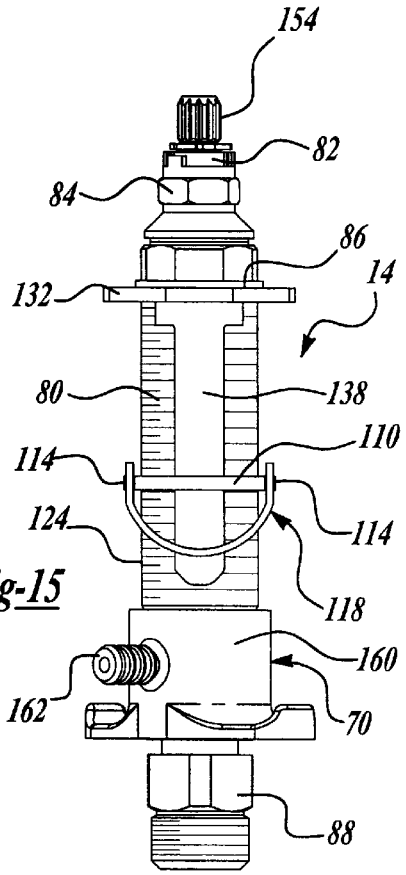
FIG. 15 is a second side view of the end body valve assembly with the pivoting retainer in the horizontal position according to the principles of the present invention.

During installation of the end body valve assembly 14, according to the principles of the present invention, the retainer member 118 is pivoted to the generally vertical position as best shown in FIGS. 11–13. The end body valve assembly 14 is then inserted through an opening 150 in the deck or mounting surface 60. After insertion of the end body valve assembly 14 through the opening 150, the retainer member 118 will rotate to a horizontal position as best shown in FIGS. 14 and 15. The rotation of the retainer member 118 is due to the mass imbalance of the retainer member 118 caused by one end of the retainer member 118 being heavier than the other due to the weight of the cross bar 124.

In order to securely fasten the end body valve assembly 14 to the deck 60, the guide flange 132 is held and the threaded body 80 is rotated in a clockwise direction in order to draw the retainer member 118 upward against the underside of the deck 60. A wrench can be used to engage the hexagonal head portion 84 of the threaded body 80 in order to tighten the end body valve assembly 14 in place. The height is automatically set for proper handle height. A lever handle (not shown) would then be applied to the upper splined portion 154 of the valve 82 as is known in the art.

Figure 32:
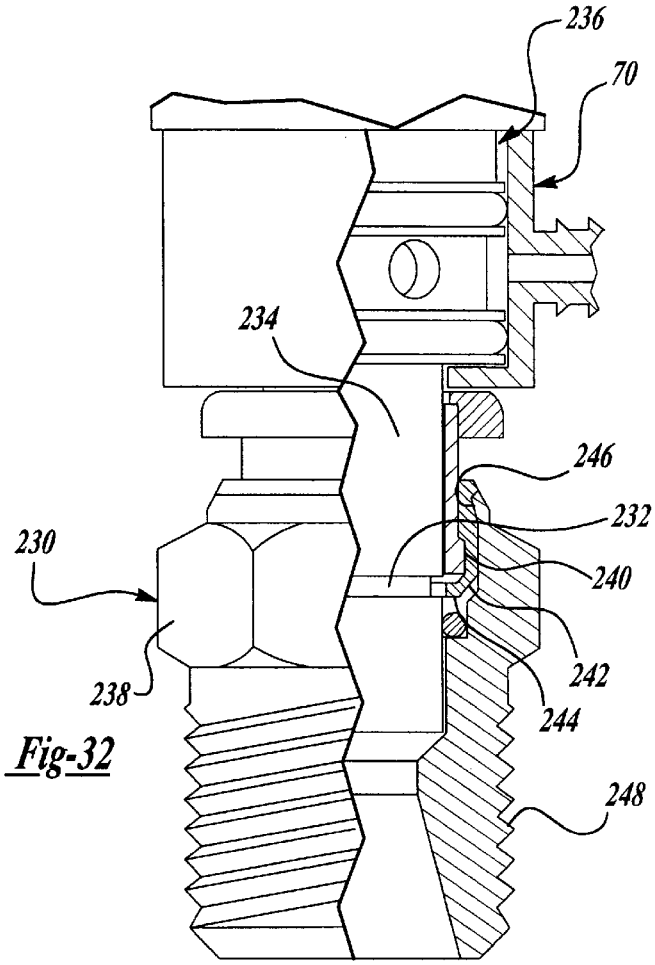
FIG. 32 is a cross-sectional view of an end body valve assembly with an alternative connector design.

At this time, the end connector 70 is attached to the end body valve assembly 14 by sliding the connector 70 over the base portion 88 of the threaded body 80 and the connector clip 72 is inserted in the groove 104 for holding the connector 70 in place. Preferably, the interconnecting hoses 74 are preassembled to the end connectors 70 and T-connector 76, thus reducing the amount of time and work done under the sink where space is limited. The end connector 70, as best shown in FIG. 16, includes a generally cylindrical body portion 160 having a radially extending port neck 162 extending therefrom. Because the body portion 160 is generally cylindrical in shape, it can rotate freely around the base portion 88 of the threaded body 80. The freedom to rotate about the threaded body 80 allows the end connectors 70 to rotate to accommodate for variations in angularity and distances between the spout 10 and the end body valve assemblies 12, 14 without kinking the hoses 74. With current designs, the hose connecting portions are disposed in a fixed direction once the valve body assemblies are mounted. Contrary to this, the freedom of rotation of the connectors 70 allow the connectors to rotate even after the body valve assemblies 12, 14 are mounted. Thus, the present invention is adaptable for use in various sink configurations. Port neck 162 includes serrations 164 on an exterior surface thereof. The serrations 164 engage with the hose 74 to secure the hose 74 to the end connector 70. As an alternative, as shown in FIG. 32, the connector 70 can be held in place by a threaded connector 230 which engages a groove 232 formed in the base portion 234 of a modified threaded body 236. The threaded connector 230 includes a main body portion 238 which receives a connector ring 240 provided with a plurality of fingers 242 with radially inwardly extending end portions 244. The interior walls 246 of the main body portion 238 are sloped so as to provide a cam for maintaining the fingers 242 engaged with the groove 232 formed in the base portion 234 of the threaded body 236. The main body portion 238 of the threaded connector 230 includes a threaded portion 248 for connecting to a water supply line (not shown). This alternative embodiment simplifies the design of the modified threaded body 236, as compared to the threaded body 80, since the threaded portion 248, for connecting to the water supply line, is formed on the threaded connector 230 instead of the base portion 88 of the threaded body 80. Preferably, the water supply line can be pre-assembled to the threaded connector 230 and the threaded connector 230 can then be simply pushed into place onto the modified threaded body 236 under the sink without the need for tools under the sink where space to work is limited. The threaded connector 230, as shown, is commercially available from the PARFLEX division of Parker Hannifin, 1300 N. Freedom Street, Ravenna, Ohio 44266.

Figure 33:
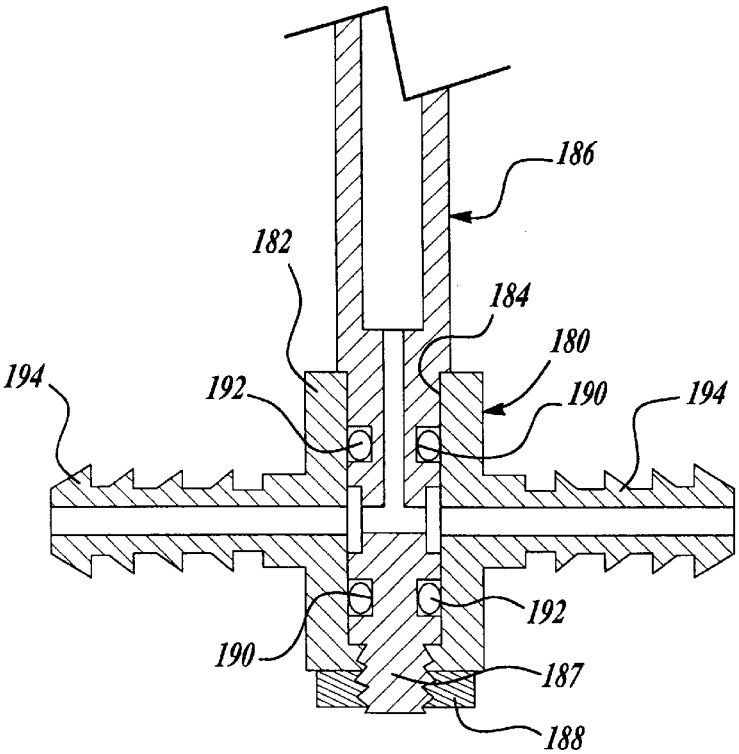
FIG. 33 is a cross-sectional view of an alternative T-connector design for use with the present invention.

The T-connector 76, shown in FIG. 1, includes a body portion 168, as best shown in FIG. 7, connected to the waterway tube 18 and further having first and second hose connector portions 170 for connecting with the hoses 74. The body portion 168, as shown in FIG. 7, supports an O-ring 172 which surrounds the waterway tube 18 as well as a connector ring 174. The connector ring 174 includes a plurality of fingers 176 which extend longitudinally and are provided with radially inwardly extending end portions 178. The radially inwardly extending end portions 178 engage an annular groove 180 formed in the exterior surface of the waterway tube 18 in order to secure the T-connector 76, as best shown in FIG. 1, to the waterway tube 18. The T-connector 76 is commercially available from the PARFLEX Division of Parker Hannifin, 1300 N. Freedom Street, Ravenna, Ohio 44266. As an alternative, a modified T-connector 180, as shown in FIG. 33, can be utilized. The T-connector 180 includes a body portion 182 including a cylindrical bore 184 for receiving the end of the waterway tube 186. The waterway tube 186 includes a threaded end portion 187 for mating with a threaded nut 188 for securing the T-connector 180 in place. The waterway tube 186 has a pair of grooves 190 which each receive an O-ring 192 for providing a watertight sealed relationship between said waterway tube 186 and the T-connector 180. The T-connector 180 includes a pair of serrated hose connector portions 194.

Figure 27:
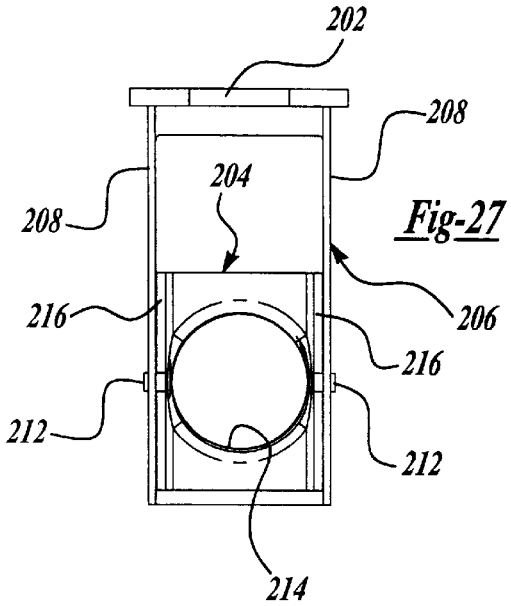
FIG. 27 is a first side view of a bracket and nut assembly according to the second embodiment of the present invention.
Figure 28:
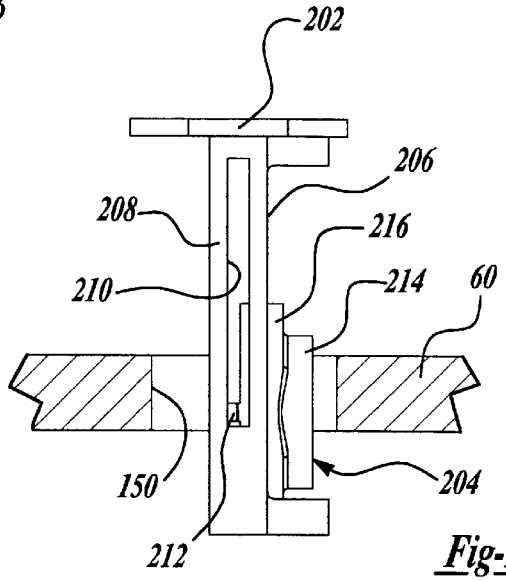
FIG. 28 illustrates a second side view of the bracket and nut assembly shown in FIG. 27 with the bracket and nut assembly being inserted through an opening in a deck.
Figure 29:
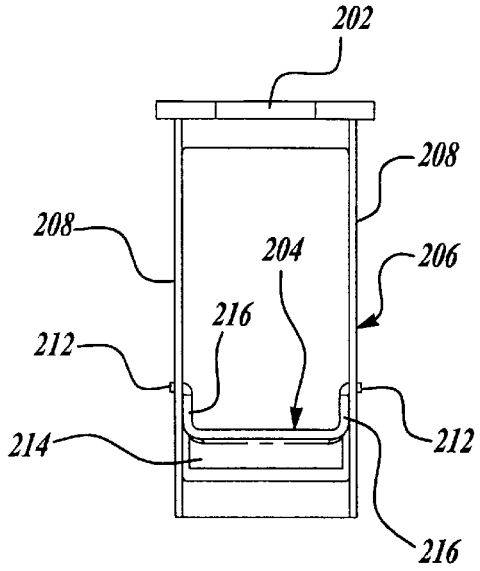
FIG. 29 is a first side view of the bracket and nut assembly shown in FIG. 27 with the retainer in the horizontal position.
Figure 30:
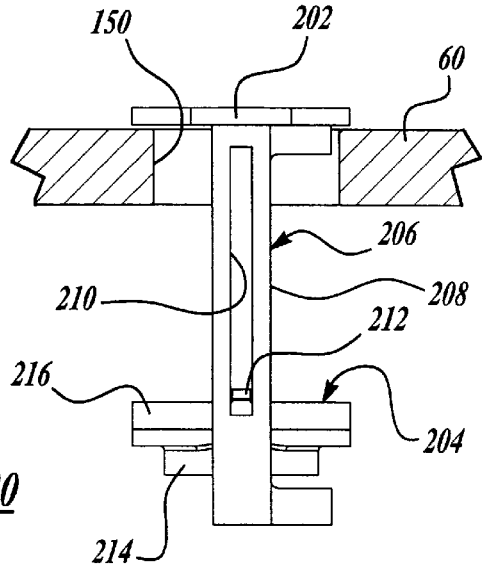
FIG. 30 is a second side view of the bracket and nut assembly shown in FIG. 29 inserted in an opening in a deck with the retainer in the horizontal position.
Figure 31:
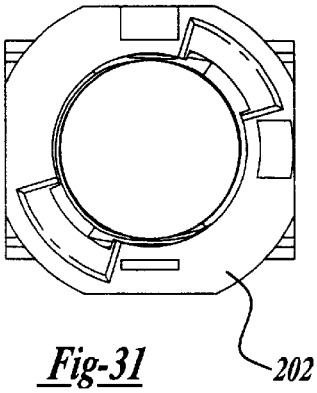
FIG. 31 is a top view of the bracket and nut assembly shown in FIG. 30.

With reference to FIGS. 25–30, a second embodiment of the end body valve assembly 200 will be described. The end body valve assembly 200 is attached to a sink or deck by an upper bracket 202 and a lower nut retainer 204, best shown in FIGS. 27–30. The upper bracket 202 is not threaded and is attached to a bracket 206. The bracket 206 includes a pair of long arms 208 with elongated slots 210. The lower nut retainer 204 has a pair of pivot arms 212 which extend laterally outward and includes a threaded body portion 214 and a pair of spaced retaining wall portions 216. The pivot arms 212 are slidably received in the elongated slots 210 of arms 208 such that the lower nut retainer 204 swivels between the two slots 210. During installation of the valve body assembly 200 the lower nut retainer 204 swings upward in a vertical position as shown in FIGS. 27 and 28 so that the lower nut retainer 204 and bracket 206 can be inserted through the opening 150 in the deck 60. The lower nut retainer 204 swings downward to a generally horizontal position due to gravity once the nut retainer 204 has passed through the opening 150. The retaining wall portions 216 of the lower nut retainer 204, in the horizontal orientation, extend over the edges of the opening 150.

An end body 220 is then inserted through a center of the upper bracket 202 and lowered to the lower nut retainer 204. The end body 220 includes a threaded outer surface 221 such that upon rotation of the end body 220, the end body 220 engages the lower nut retainer 204. To tighten the end body 220 to the deck, the upper bracket 202 can be held in place while the threaded valve body 220 is rotated. The valve body rotation causes the lower nut retainer 204 to move up the threaded valve body 220 until the deck 60 is sandwiched by the upper bracket 202 and lower nut retainer 204. In this embodiment, the end body 220 supports a valve 82 and an internal spacer tube 92 in the same manner as shown in FIG. 16.

The quick connect faucet assembly, according to the principles of the present invention, provides an installation which is much faster than conventional faucets. Furthermore, installation is simplified since all components are tightened from above the sink.

The quick install faucet assembly of the present invention has no loose parts that can be misplaced. The end body and spout can be preassembled and ready for installation by the user.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A faucet assembly, comprising:

a spout adapted to be mounted to a deck, said spout including a water passage therethrough and a waterway tube connected to said water passage;

a T-connector slidably mounted on an end of said waterway tube, said T-connector including a pair of hose connecting portions;

a pair of end body valve assemblies adapted to be mounted to a deck;

a pair of connector members mounted to said pair of end body valve assemblies, said connector members including a hollow body portion which slidably receives a bottom portion of said end body valve assemblies and an outwardly extending hose connecting portion; and a first hose connected at one end to one of said hose connecting portions of said T-connector and at a second end to said hose connecting portion of one of said pair of connector members and a second hose connected at one end to the other of said hose connecting portions of said T-connector and at a second end to said hose connecting portion of the other of said pair of connector members.

2. The faucet assembly according to claim 1, wherein said hose connecting portions of said T-connector include a plurality of serrations on an exterior surface for insertion in said first and second hoses.

3. The faucet assembly according to claim 1, wherein said hose connecting portion of said pair of connector members include a plurality of serrations on an exterior surface for insertion in said first and second hoses.

4. The faucet assembly according to claim 1, wherein said waterway tube includes a pair of annular grooves which support a pair of O-rings, said O-rings mating with an interior surface of said T-connector for providing a water tight seal between said waterway tube and said T-connector.

5. The faucet assembly according to claim 4, wherein said T-connector is secured to said waterway tube by a threaded fastener.

6. The faucet assembly according to claim 4, wherein said T-connector includes a self coupling mechanism which engages an annular groove formed in an exterior surface of said waterway tube.

7. The faucet assembly according to claim 1, wherein said end body valve assemblies each include a pair of annular grooves formed in a base portion thereof which support a pair of O-rings, said O-rings mating with an interior surface of said connector members for providing a water tight seal between said end body valve assemblies and said connector members.

8. The faucet assembly according to claim 7, wherein said pair of connector members are secured to said pair of end body valve assemblies by a clip.

9. The faucet assembly according to claim 7, further comprising a pair of self coupling connecting members mounted on said end body valve assemblies and securing said connector members to said end body valve assemblies.

10. A hose assembly for use with a faucet including a pair of end body valve assemblies mounted to a deck, and a spout mounted to the deck and having a waterway tube connected to the spout, said hose assembly comprising:

a T-connector having a first portion adapted to be slidably mounted on an end of the waterway tube of the faucet and a pair of hose connecting portions;

a pair of connector members including a hollow body portion adapted to be slid over a bottom portion of the end body valve assemblies and having a hose connecting portion extending outwardly from said hollow body portion; and a first hose connected at one end to one of said hose connecting portions of said T-connector and at a second end to said hose connecting portion of one of said pair of connector members and a second hose connected at one end to the other of said hose connecting portions of said T-connector and at a second end to said hose connecting portion of the other of said pair of connector members;

wherein said T-connector and said pair of connector members are adapted to be slidably pushed into place over the waterway tube and the pair of end body valve assemblies, respectively.

11. The hose assembly according to claim 10, wherein said hose connecting portions of said T-connector include a plurality of serrations on an exterior surface for insertion in said first and second hoses.

12. The hose assembly according to claim 10, wherein said hose connecting portion of said pair of connector members include a plurality of serrations on an exterior surface for insertion in said first and second hoses.

13. The hose assembly according to claim 10, wherein said T-connector includes a self coupling mechanism which is adapted to engage an annular groove formed in an exterior surface of the waterway tube.

14. The hose assembly according to claim 10, further comprising a pair of water supply lines adapted to be connected to the pair of end body valve assemblies by a pair of self coupling threaded connector members which are adapted to engage an annular groove formed in an exterior surface of the pair of end body valve assemblies.

15. The hose assembly according to claim 10, wherein said pair of connector members are adapted to be freely rotatable relative to the end body valve assemblies.

16. The faucet assembly according to claim 1, wherein said pair of connector members are freely rotatable relative to said pair of end body valve assemblies.

17. A faucet assembly, comprising:

a spout adapted to be mounted to a deck, said spout including a water passage therethrough and a waterway tube connected to said water passage;

a T-connector mounted on an end of said waterway tube, said T-connector including a pair of hose connecting portions;

a pair of end body valve assemblies adapted to be mounted to a deck;

a pair of connector members mounted to said pair of end body valve assemblies, said connector members including a hollow body portion and a hose connecting portion extending outwardly from said hollow body portion, a bottom portion of said pair of end body valve assemblies being axially slidably received in said hollow body portion of said pair of connectors and forming a fluid tight seal therewith, said pair of connector members being freely rotatable relative to said end body valve assemblies without interfering with said fluid tight seal; and a first hose connected at one end to one of said hose connecting portions of said T-connector and at a second end to said hose connecting portion of one of said pair of connector members and a second hose connected at one end to the other of said hose connecting portions of said T-connector and at a second end to said hose connecting portion of the other of said pair of connector members.

* * * * *